US007284483B2

(12) United States Patent
Bachmeir et al.

(10) Patent No.: US 7,284,483 B2
(45) Date of Patent: Oct. 23, 2007

(54) SELF-CONTAINED INDEPENDENT INKING UNIT FOR PRINTING PRESS

(75) Inventors: Xaver Bachmeir, Haunswies (DE); Robert Konrad, Augsburg (DE); Harald Lesti, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/510,379

(22) PCT Filed: Apr. 5, 2003

(86) PCT No.: PCT/EP03/03564

§ 371 (c)(1),
(2), (4) Date: Oct. 5, 2004

(87) PCT Pub. No.: WO03/084755

PCT Pub. Date: Oct. 16, 2003

(65) Prior Publication Data

US 2005/0211118 A1 Sep. 29, 2005

(30) Foreign Application Priority Data

Apr. 9, 2002 (DE) ..... 102 15 615

(51) Int. Cl.
*B41F 31/02* (2006.01)

(52) U.S. Cl. ..... 101/350.1; 101/479; 101/DIG. 35

(58) Field of Classification Search ..... 101/DIG. 35, 101/349.1, 147, 351.1, 352.01, 247, 137, 101/479, 480, 348, 350.1
See application file for complete search history.

(56) References Cited

U.S. PATENT DOCUMENTS

| | | | | |
|---|---|---|---|---|
| 3,601,049 | A | 8/1971 | Hamilton | |
| 4,889,051 | A | 12/1989 | Sarda | |
| 5,752,440 | A * | 5/1998 | Schaum | 101/91 |
| 5,794,531 | A * | 8/1998 | Keller | 101/479 |
| 5,960,713 | A | 10/1999 | DeMoore et al. | |
| 6,024,015 | A * | 2/2000 | Dillig et al. | 101/350.5 |
| 6,116,158 | A | 9/2000 | DeMoore et al. | |
| 6,435,086 | B1 | 8/2002 | Rendleman et al. | |
| 6,502,509 | B2 | 1/2003 | Göttling et al. | |
| 6,748,859 | B2 * | 6/2004 | Goldburt et al. | 101/350.1 |

FOREIGN PATENT DOCUMENTS

| | | |
|---|---|---|
| DE | 1 233 415 | 2/1967 |
| DE | 23 43 099 C3 | 4/1976 |
| DE | 32 09 740 A1 | 12/1982 |
| DE | 38 80 049 T2 | 7/1993 |
| DE | 696 11 630 T2 | 6/2001 |

* cited by examiner

*Primary Examiner*—Leslie J. Evanisko
(74) *Attorney, Agent, or Firm*—Cohen Pontani Lieberman & Pavane LLP

(57) ABSTRACT

An inking unit for printing units of rotary presses is independent of the printing unit and is configured as a self-contained unit. The linking unit can be removed from the printing unit and has a dedicated drive for a plurality of rolls, the drive being arranged on side walls which are assigned to the inking unit.

12 Claims, 2 Drawing Sheets

SELF-CONTAINED INDEPENDENT INKING UNIT FOR PRINTING PRESS

PRIORITY CLAIM

This is a U.S. national stage of application No. PCT/EP03/03564, filed on 5 Apr. 2003. Priority is claimed on that application and on the following application(s): Country: Germany, Application No.: 102 15 615.8, Filed: 9 Apr. 2002.

BACKGROUND OF THE INVENTION

1. Field of the Invention

The invention relates to an inking unit for printing units of rotary presses.

2. Description of Prior Art

U.S. Pat. No. 4,889,051 discloses a sheet-processing offset printing press with a movable inking unit module, the inking unit module being driven by the drive of the printing unit via gear wheel connections.

SUMMARY OF THE INVENTION

An object of the present invention is to provide an inking unit which is independent of the printing unit and is configured as a self-contained unit.

According to the invention, the object is achieved by an inking unit for a printing unit of a rotary printing press, wherein the inking unit is removably receivable in the printing unit. The inking unit includes side walls, a plurality of rolls arranged between the side walls, and a dedicated drive mounted on at least one of the side walls of said inking unit for driving the plurality of rolls.

It is an advantage of the invention that the inking unit, which is configured as a structurally self-contained unit, is configured as a cassette with its own side walls and cross-members. It is particularly advantageous that the drives for rolls, distributors and ink ductor are integrated in the inking unit. Furthermore, it is significant that a dampening unit can be integrated in the inking unit, the drives which belong to the dampening unit, for example the drive of the dampening solution dip roll, likewise being integrated in the inking unit. The inking unit can also be configured with valve islands, in order for it to be possible to connect the inking unit or the dampening unit integrated in the latter to an ink supply, dampening solution supply and/or pressure medium supply.

The inking unit can be installed in the printing unit and dismantled simply and in a short time for maintenance, service and exchanging.

It is significant that it is possible to completely preassemble and test the inking unit configured in such a way.

One significant advantage is that the inking unit can be operated outside the printing unit for test or service purposes in an apparatus which has identical or similar mechanical, fluid and electrical interfaces to the printing unit.

It should be mentioned, in particular, that the inking unit can be replaced by a structurally identical inking unit while maintenance and repair work is being performed, in order to increase the availability of the machine.

The inking unit according to the invention has simple mechanical interfaces via centering elements with or without a locking means to a receptacle, the receptacle being arranged fixedly or movably about at least one axis in the printing unit.

In order to perform other printing methods, it is possible to arrange an inking unit for toner printing, flexographic printing or gravure printing, instead of the inking unit for offset printing, on the receptacle, the inking units all having identical mechanical interfaces. Furthermore, the offset printing inking units can also vary to the effect that zonal inking units, zoneless inking units, inking units for heatset inks, coldest inks, sheet printing inks and radiation-curable inks can be exchanged for one another, the inking units all having identical mechanical interfaces. A varnishing unit can also be arranged in the receptacle instead of the inking unit, the varnishing unit having identical mechanical interfaces as the abovementioned inking units.

Furthermore, the inking unit has fluid interfaces which are easy to operate and simply configured for pneumatics, hydraulics, ink supply, dampening solution circuit and temperature control means, the fluid interfaces being configured, for example, with quick-action couplings.

The inking unit is configured with electrical interfaces which are easy to operate and simply configured for drives (motors), machine control and field bus connection (data bus connection), the electrical interfaces being, for example, plug-in connections.

It is significant that the inking unit can be installed and dismantled without tools by means of apparatuses which are attached to a base or a crane in the printing unit or in the abovementioned testing and service apparatus.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
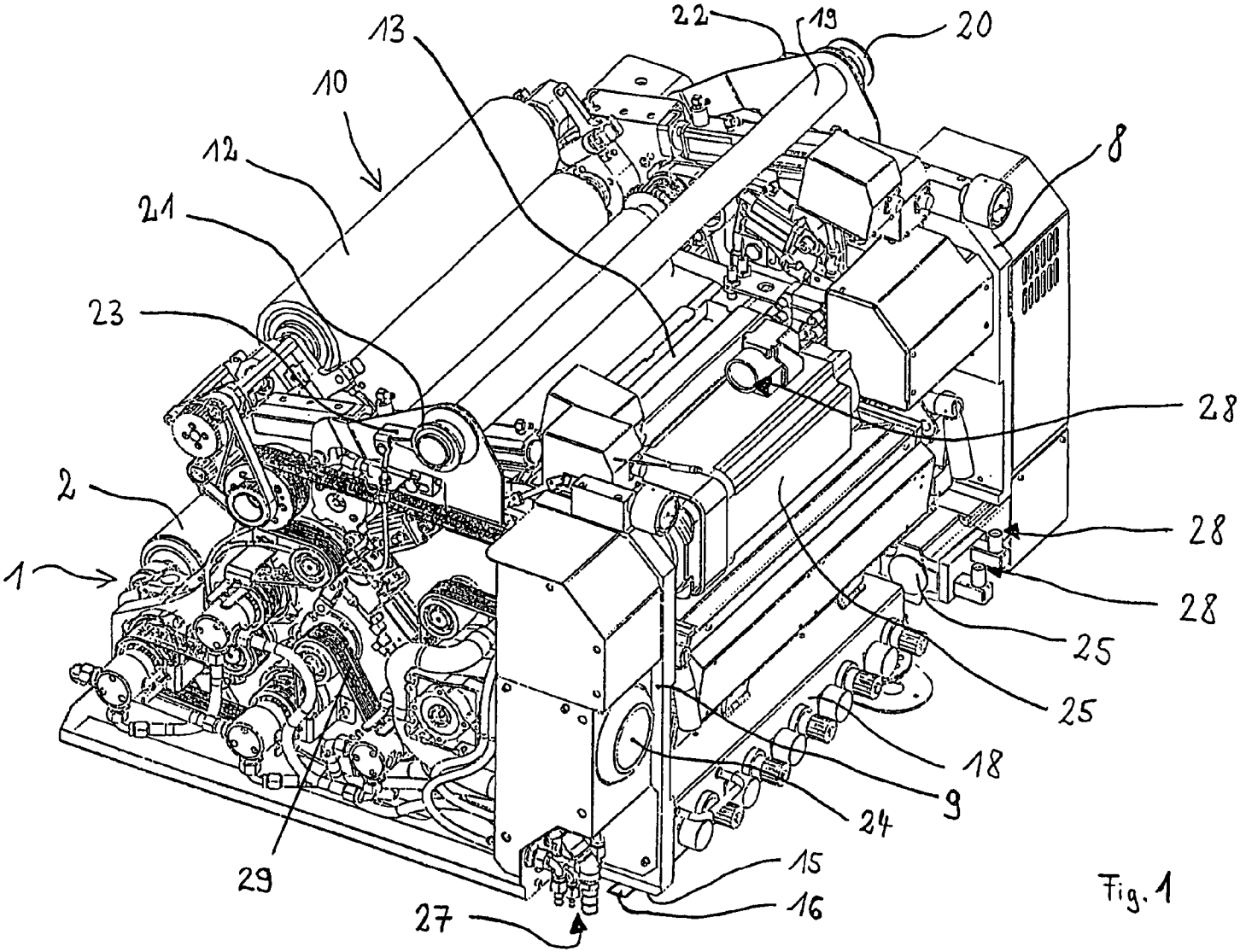
FIG. 1 is a perspective view of the top and front side of an inking unit according to the invention.
Figure 2:
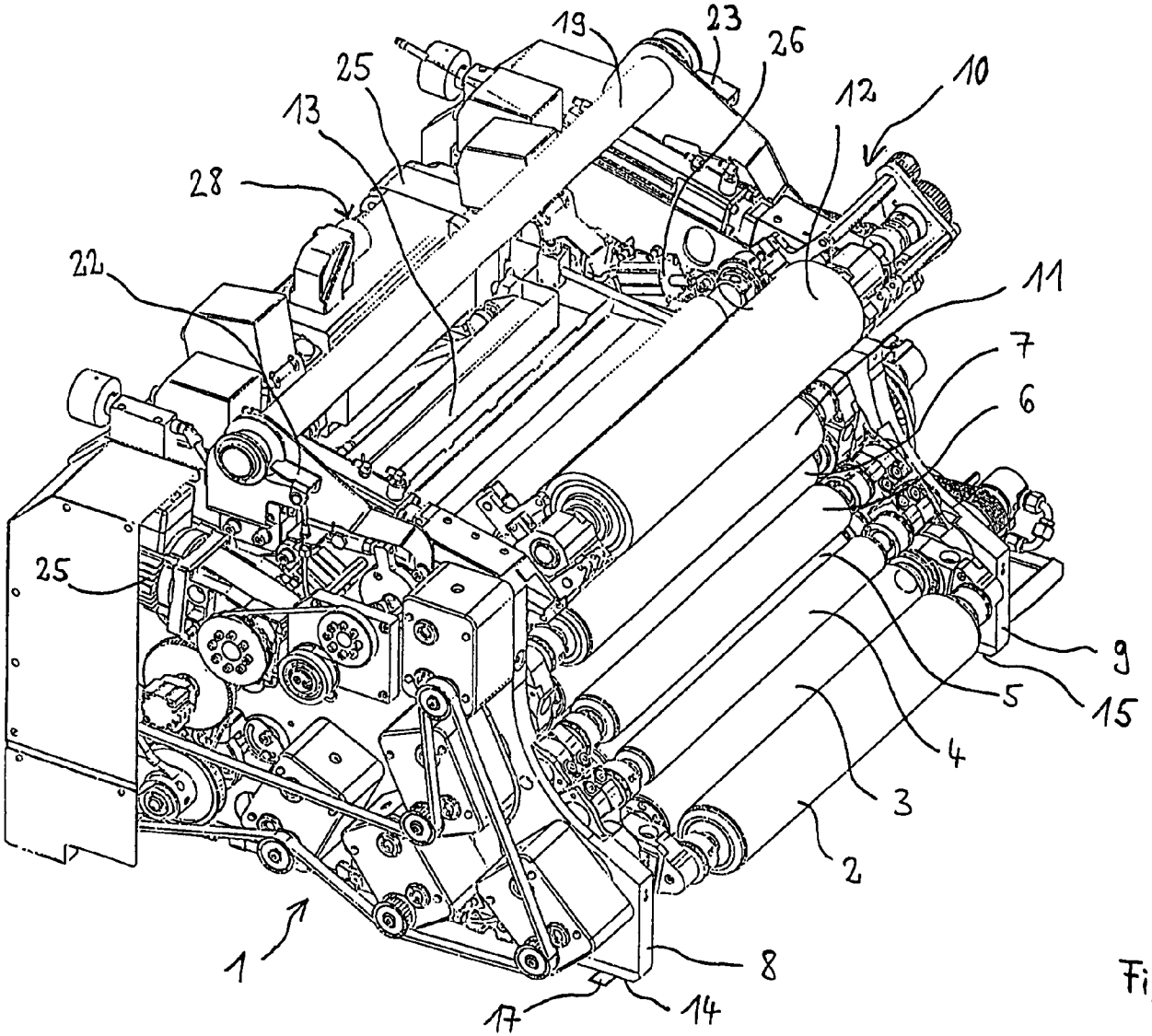
FIG. 2 is a perspective view of the top and rear side of the inking unit in FIG. 1.

FIG. 1 and FIG. 2 show an inking unit 1, whose rolls 2 to 7, for example applicator rolls and distributor rolls, are mounted between side walls 8; 9. Additionally, a dampening unit 10 can also be integrated in the inking unit 1, which dampening unit 10 diagrammatically comprises the rolls 11; 12, for example applicator rolls and distributor rolls, and the dampening solution fountain 13, the rolls 11; 12 and the dampening solution fountain 13 being mounted between the side walls 8; 9.

The side walls 8; 9 are configured with guide elements 14; 15 and stops 16; 17, by means of which the inking unit 1 (not shown in greater detail) can be arranged positionally correctly and such that it can be pushed onto guide elements and/or latching elements or positioning apparatuses arranged in side walls of the printing unit. The inking unit 1 with its guide elements 14; 15 and its stops 16; 17 (not shown in greater detail) can be attached, for example, to a receptacle apparatus which is arranged in the printing unit or on an apparatus situated outside the printing unit for performing test, repair and/or service work. The receptacle apparatus can be configured as a cross slide, as already described in U.S. Pat. No. 6,502,509, the entire contents of which are incorporated herein by reference.

The inking unit 1 with its guide elements 14; 15 and its stops 16; 17 can additionally be moved against positioning apparatuses arranged on the receptacle apparatus. Said positioning apparatus can be configured with a locking means (not shown in greater detail).

Using the positioning apparatus, the inking unit 1 is moved into a correct position with respect to the impression cylinders, or this correct position is secured. The ink fountain 18 and a stop element 19 are arranged between the side walls 8; 9. The stop element 19 is configured with roll elements 20; 21 at its ends. An apparatus which is attached to a base or a crane for transporting the inking unit 1 can be arranged on the stop element 19 and/or its roll elements 20, 21 (not shown in greater detail). The inking unit 1 can be installed and dismantled without tools, apart from the use of the transport apparatus because of the high weight of the inking unit 1. In order to dismantle the inking unit 1, the stops 16, 17 must be unlocked by means of an unlocking means 22; 23 if said stops 16; 17 were locked at the positioning apparatus.

The inking unit 1 is configured with at least one drive motor 24 which is mounted, for example, on the side wall 9. The rolls 2 to 7; 11; 12 can be driven by the drive motor 24, for example via a belt 29 or some other mechanisms or mechanical chive connections. Further drives, for example servo drives 25 and/or operating cylinders 26 operated by pressure medium, can also be arranged on the side walls 8; 9. The rolls 2 to 7; 11; 12, as described in the U.S. patent application Ser. No. 10/509,812 submitted in parallel with this document, can be adapted to various impression cylinder diameters, for example in terms of their position, by means of the servo drives 25 or the operating cylinders 26. For example, the stroke of the rolls 2 to 7; 11; 12 which are configured as distributor rolls can be adjusted by means of the servo drives 25. The inking unit 1 is therefore configured with fluid interfaces 27 and/or interfaces 27 which conduct pressure medium and electrical interfaces 28 for operating and controlling the abovementioned drives. It is also possible to connect ink supply devices and/or dampening solution supply devices to the inking unit 1 via the interfaces 27. The energy supply and machine controller, in particular, are connected to the inking unit 1 or to the drives 24 to 26 integrated in the inking unit 1 via the electrical interfaces 28. The fluid interfaces 27 are configured, for example, with quick-action couplings. The electrical interfaces 28 are configured, for example, as plug-in connections.

What is claimed is:

1. An inking unit for a printing unit of a rotary printing press, said inking unit comprising:

side walls;

a plurality of rolls arranged between said side walls;

a dedicated drive mounted on at least one of said side walls of said inking unit for driving said plurality of rolls;

guides arranged on and extending along the respective side walls of said inking unit and configured to interact with complementary guides on side walls of the printing unit so that said inking unit is insertable into and removable from the printing unit by said guides; and interfaces for at least one of pressure medium supply, ink supply, dampening solution supply, and temperature control connections, said interfaces comprising quick-action couplings.

2. The inking unit of claim 1, further comprising a damping unit.

3. The inking unit of claim 2, wherein said damping unit comprises damping rolls, said dedicated drive being operatively arranged for driving said damping rolls.

4. The inking unit of claim 1, wherein said plurality of rolls comprise one of distributor rolls and applicator rolls.

5. The inking unit of claim 1, further comprising stops, said inking unit configured as a cassette that is positionable in the printing unit using said stops.

6. The inking unit of claim 5, wherein each side wall of said inking unit comprises a bottom edge, the guides being arranged on and extending along the bottom edges of the respective side walls.

7. The inking unit of claim 6, wherein said stops are arranged on the respective guides.

8. The inking unit of claim 1, further comprising electrical interfaces for at least one of power, control, and data bus connections.

9. The inking unit of claim 1, further comprising at least one of a servo drive and a pressure medium operated operating cylinder.

10. The inking unit of claim 1, wherein said inking unit is installable in and removable from the printing unit without tools.

11. The inking unit of claim 1, wherein said inking unit is removable from the printing unit and operable in a further apparatus.

12. The inking unit of claim 11, wherein said inking unit is operable in the further apparatus that has compatible mechanical, fluid and electrical connections.

* * * * *